US011285505B2

(12) United States Patent
Adams

(10) Patent No.: US 11,285,505 B2
(45) Date of Patent: Mar. 29, 2022

(54) WATERFALL SINK

(71) Applicant: Russell Adams, Sugar Hill, GA (US)

(72) Inventor: Russell Adams, Sugar Hill, GA (US)

(73) Assignee: MTI Baths, Inc., Sugar Hill, GA (US)

( * ) Notice: Subject to any disclaimer, the term of this patent is extended or adjusted under 35 U.S.C. 154(b) by 0 days.

(21) Appl. No.: 17/126,868

(22) Filed: Dec. 18, 2020

(65) Prior Publication Data

US 2021/0187539 A1 Jun. 24, 2021

Related U.S. Application Data

(60) Provisional application No. 62/950,514, filed on Dec. 19, 2019.

(51) Int. Cl.
*B05B 17/08* (2006.01)
*E03C 1/182* (2006.01)

(52) U.S. Cl.
CPC ..... *B05B 17/085* (2013.01); *E03C 1/182* (2013.01)

(58) Field of Classification Search
CPC ..... B05B 17/085; B05B 17/08; E03C 1/182; E03C 1/18; D06F 1/00
USPC ..... 4/650, 642, 619
See application file for complete search history.

(56) References Cited

U.S. PATENT DOCUMENTS 139,684 A * 6/1873 Morahan ..... D06F 1/04 68/233
2,008,349 A * 7/1935 Crane ..... E03C 1/18 4/637
2,026,952 A * 1/1936 Reed ..... E03C 1/18 4/637
2,262,093 A * 11/1941 Burman ..... D06F 1/00 4/639
D179,031 S * 10/1956 Parker ..... D23/287
2,847,681 A * 8/1958 Jacobs ..... E03C 1/182 4/653
4,587,680 A * 5/1986 Brugger ..... A45D 19/00 4/519
5,167,368 A * 12/1992 Nash ..... B05B 17/085 239/17
5,412,818 A * 5/1995 Chen ..... E03C 1/14 4/637
5,644,943 A * 7/1997 Lanz ..... B21D 22/26 72/348
6,318,387 B1 * 11/2001 McClure ..... C02F 3/04 134/111
6,460,483 B1 * 10/2002 Northrop ..... A01K 7/00 119/702

(Continued)

*Primary Examiner* — Benjamin R Shaw
(74) *Attorney, Agent, or Firm* — Miller & Martin PLLC; Stephen J. Stark

(57) ABSTRACT

A waterfall sink has a series of contours as elevationally spaced apart upper steps separated by vertically extending walls extending from an upper surface of to a bottom surface to form a partial sink bowl. The bottom surface directs fluid from the partial sink bowl off a side edge to then downwardly proceed to a drain below the bottom surface. Many embodiments have a channel extending into a side surface along the side which receives the fluid from the partial bowl. Some embodiments have side steps which coordinate with the upper steps to form a continuous partial perimeter. Water from a faucet directed into the partial bowl proceeds above the bottom surface and over the side edge downwardly like a waterfall.

20 Claims, 6 Drawing Sheets

(56) References Cited

U.S. PATENT DOCUMENTS

| | | | | |
|---|---|---|---|---|
| 8,985,054 | B2 * | 3/2015 | Lipscomb | A01K 7/02 119/74 |
| 2002/0078497 | A1 * | 6/2002 | Perucchi | A47J 47/20 4/642 |
| 2002/0184704 | A1 * | 12/2002 | Cawthon | E03C 1/326 4/619 |
| 2003/0046758 | A1 * | 3/2003 | Gerloff | E03C 1/18 4/619 |
| 2004/0068791 | A1 * | 4/2004 | Fellencer | A47K 1/02 4/639 |
| 2008/0148475 | A1 * | 6/2008 | Lin | A47L 17/02 4/631 |
| 2011/0067638 | A1 * | 3/2011 | Lipscomb | F04B 23/021 119/74 |
| 2015/0067962 | A1 * | 3/2015 | O'Brien | E03C 1/18 4/630 |
| 2020/0277769 | A1 * | 9/2020 | Chong | E03C 1/04 |
| 2021/0196083 | A1 * | 7/2021 | Raleigh | A47J 47/005 |

* cited by examiner

WATERFALL SINK

CLAIM OF PRIORITY

This application claims the benefit of U.S. Provisional Application No. 62/950,514 filed Dec. 19, 2019 which is incorporated herein by reference in its entirety.

FIELD OF THE INVENTION

The present invention relates to an elevation or contour-line sink construction whereby a partial sink bowl has a series of elevational steps from toward an upper surface toward a bottom surface layer and the bottom surface layers direct fluid to a side edge of the sink and then downwardly along a waterfall face channel to a drain at or towards the floor below the sink bowl.

BACKGROUND OF THE INVENTION

A number of companies have sold elevation or contour line sink basin bowls that direct to an internally disposed drain within a perimeter of the contour lines internal to the bowl as seen from above. See FIG. 7. The series of contour lines progress from a progressively larger perimeter to a progressively smaller perimeter to a bottom level with a drain internal to the perimeter of the bottom level.

While attractive designs can be made using this effect, the applicant believes that there is a need for additional designs and/or features in the marketplace.

Specifically, with all the prior art constructions, drain piping effluent from the sink bowl is directed with pipes, normally in the form of PVC or metal piping, that are visible to the user and/or typically covered up with cabinetry or other structure.

The applicant believes there is at least some applications whereby improved designs can overcome these or other prior art deficiencies.

SUMMARY OF THE INVENTION

It is a present object of many embodiments of the present invention to provide an improved sink construction having a waterfall contour construction whereby water is directed off a side edge of a sink construction.

It is another object of many embodiments of the present invention to provide an improved waterfall construction whereby as water as it leaves a sink bowl-portion, water is directed from a bottom step surface off a side edge of the sink towards a drain below.

It is a present object of many embodiments of the present invention to provide a partial sink basin bowl without an internal drain therein which directs water receiving in the bowl portion out a side waterfall structure.

It is yet another object of many embodiments of the present invention to provide an improved sink construction.

Accordingly, in accordance with many embodiments of the present invention, a sink construction provide an upper surface which defines a top of a partial bowl portion whereby as the bowl proceeds through and/or into the upper surface of the sink construction (such as a solid surface and/or other planar surface for many embodiments), a series of elevation or contour lines appear which are directed to an edge of a sink such as a linear edge.

For many embodiments the elevation lines maintain a constant elevation particularly relative to the upper surface and/or lower surface of the sink and/or are directed slightly downwardly oriented toward a bottom step level so that they terminate at an edge or gradual edge so as to create an optical effect of being a contour map extending downwardly such as into a valley. Some embodiments could have converging and/or diverging contour lines as well.

Along one or more sides of the sink, the contours stop at an edge or edges, but are possibly met by outwardly extending side contour levels which extend downwardly from the edge at the upper counter surface so as to provide a waterfall style construction whereby water received in the partial bowl portion proceeds downwardly towards a bottommost upper surface level which is preferably flat or downwardly angled towards an exit side whereby water then flows down the waterfall in a channel which preferably begins at a bottom side surface which could be perpendicular to the bottommost upper surface of the basin or is angled at an angle greater than 90° thereto so that water may tend to run along the bottom of the side surface of the channel as opposed to potentially jumping off that surface. Water preferably proceeds downwardly towards a floor surface drain and/or an internally connected drain within the side edge or leg of the sink so that, for many embodiments, no drain piping is visible to a user, but instead a waterfall may be observed as it proceeds away from the bottom level of the partial sink bowl and along and down the waterfall for at least a length of travel, if not all the way to the floor off the side.

With an exposed channel formed into the side surface and proceeding downwardly, at least some of the waterfall may be viewed if not all the waterfall is viewed for at least some embodiments. It may be that for some embodiments that a catch is provided so as to catch water as it proceeds outwardly to keep it from continuing outwardly away from the waterfall effect for at least some embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
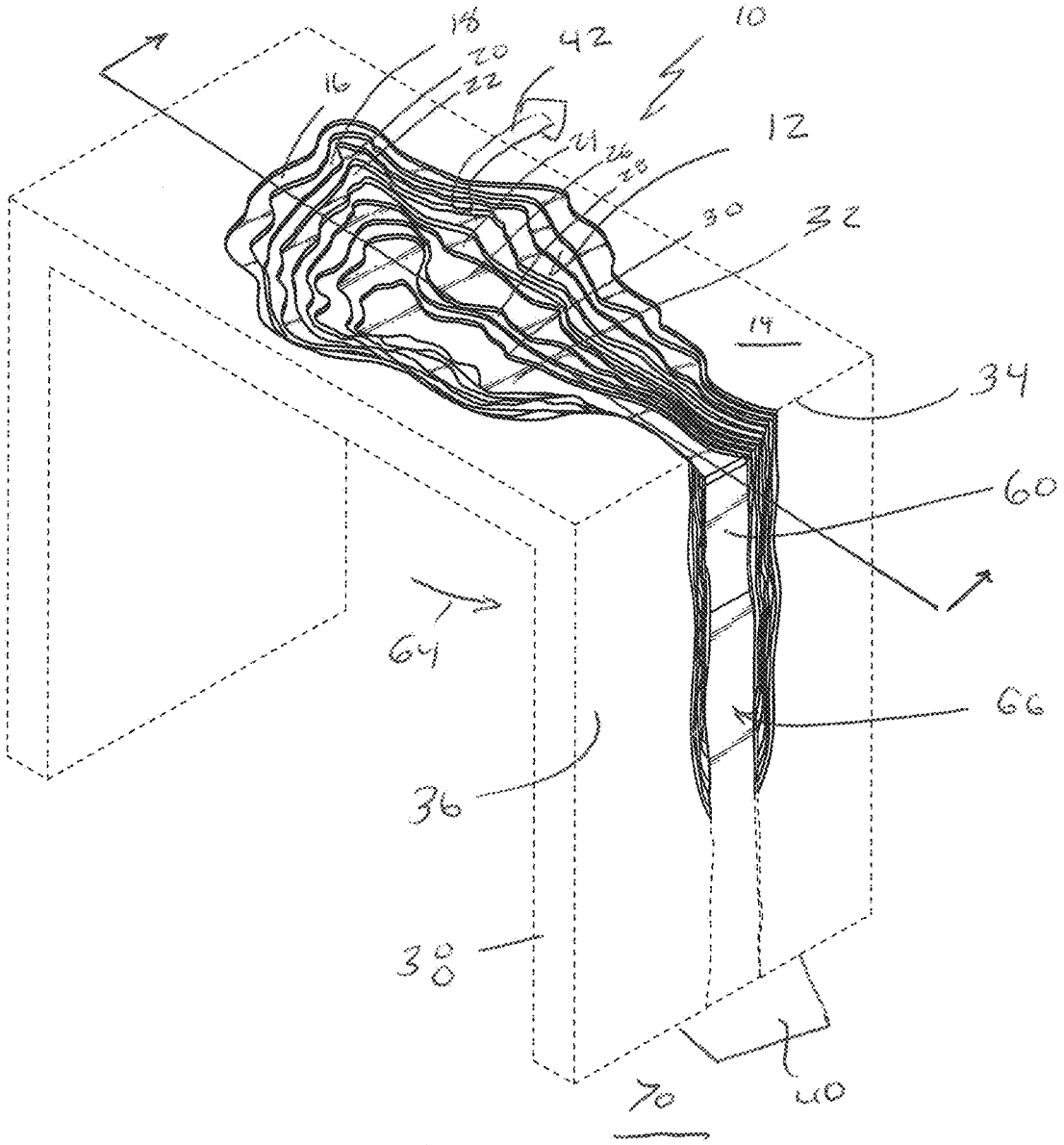
FIG. 1 is a perspective view of a presently preferred embodiment of the present invention.
Figure 2:
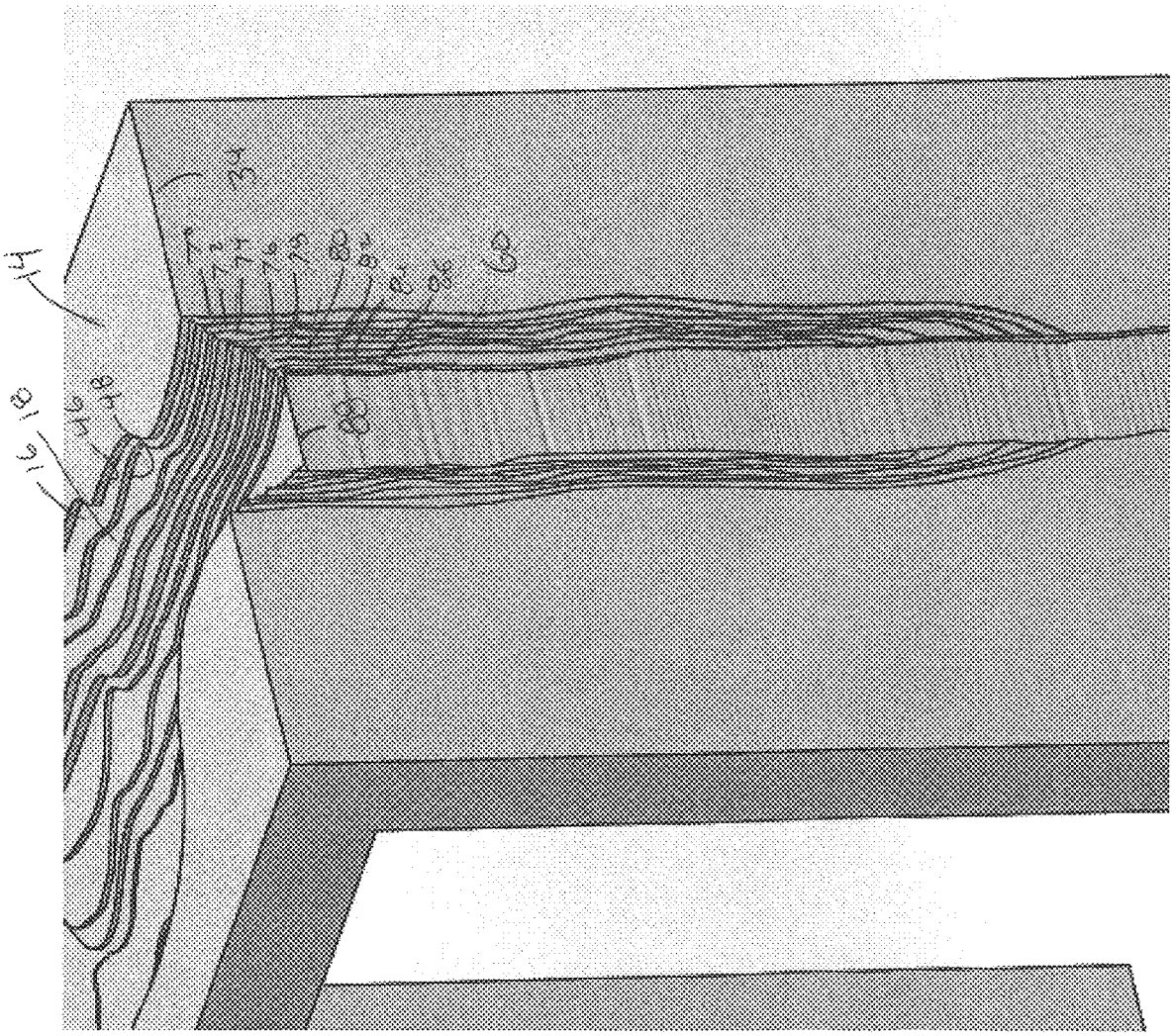
FIG. 2 is a detailed side perspective view of a portion of the embodiment shown in FIG. 1.
Figure 3:
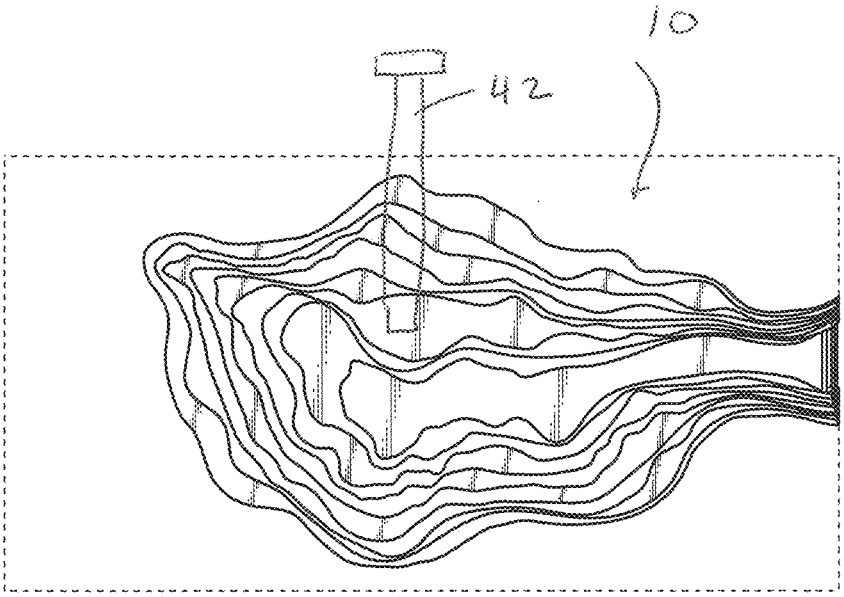
FIG. 3 is a top plan view of the present embodiment shown in FIGS. 1-2.
Figure 4:
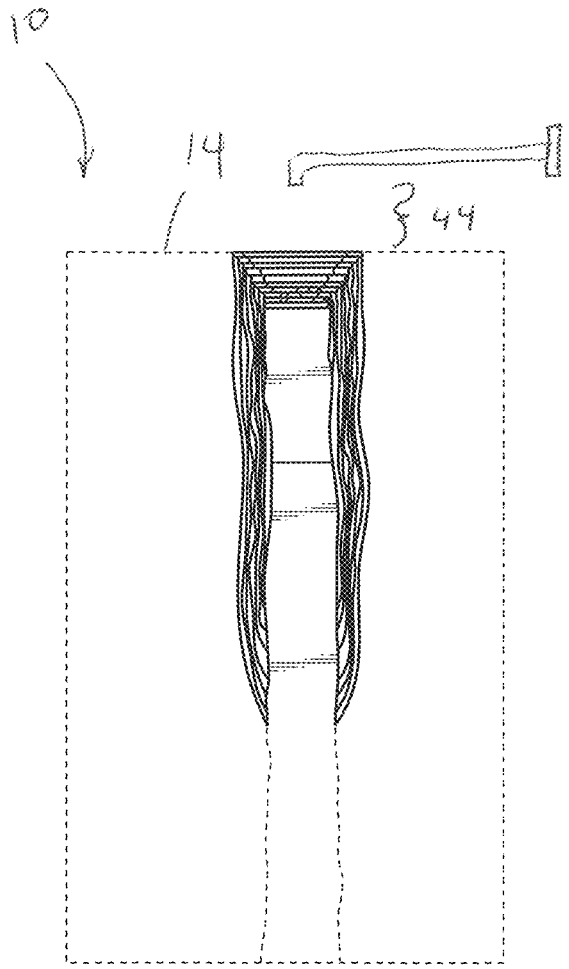
FIG. 4 is a side plan view of the embodiment of FIGS. 1-3 with the bowl portion shown in phantom.
Figure 5:
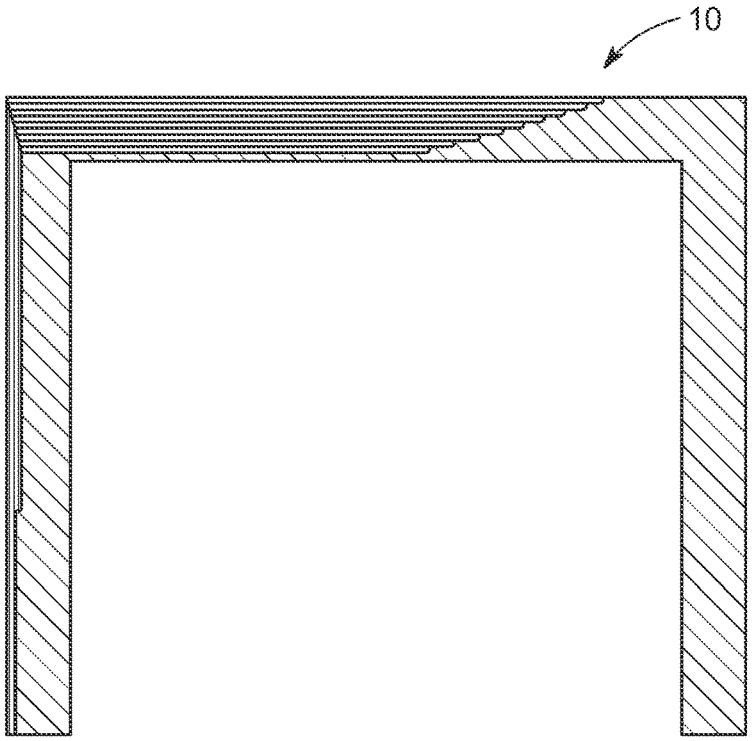
FIG. 5 is a cross sectional view taken along line AA of in FIG. 4.
Figure 6:
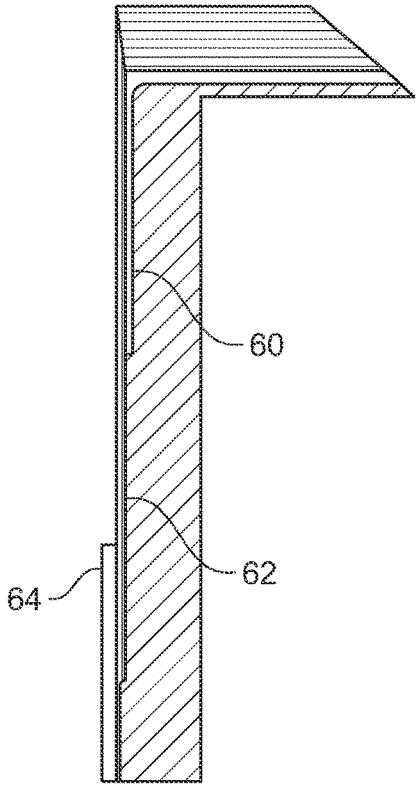
FIG. 6 is a detailed view of a portion as shown in FIG. 5.
Figure 7:
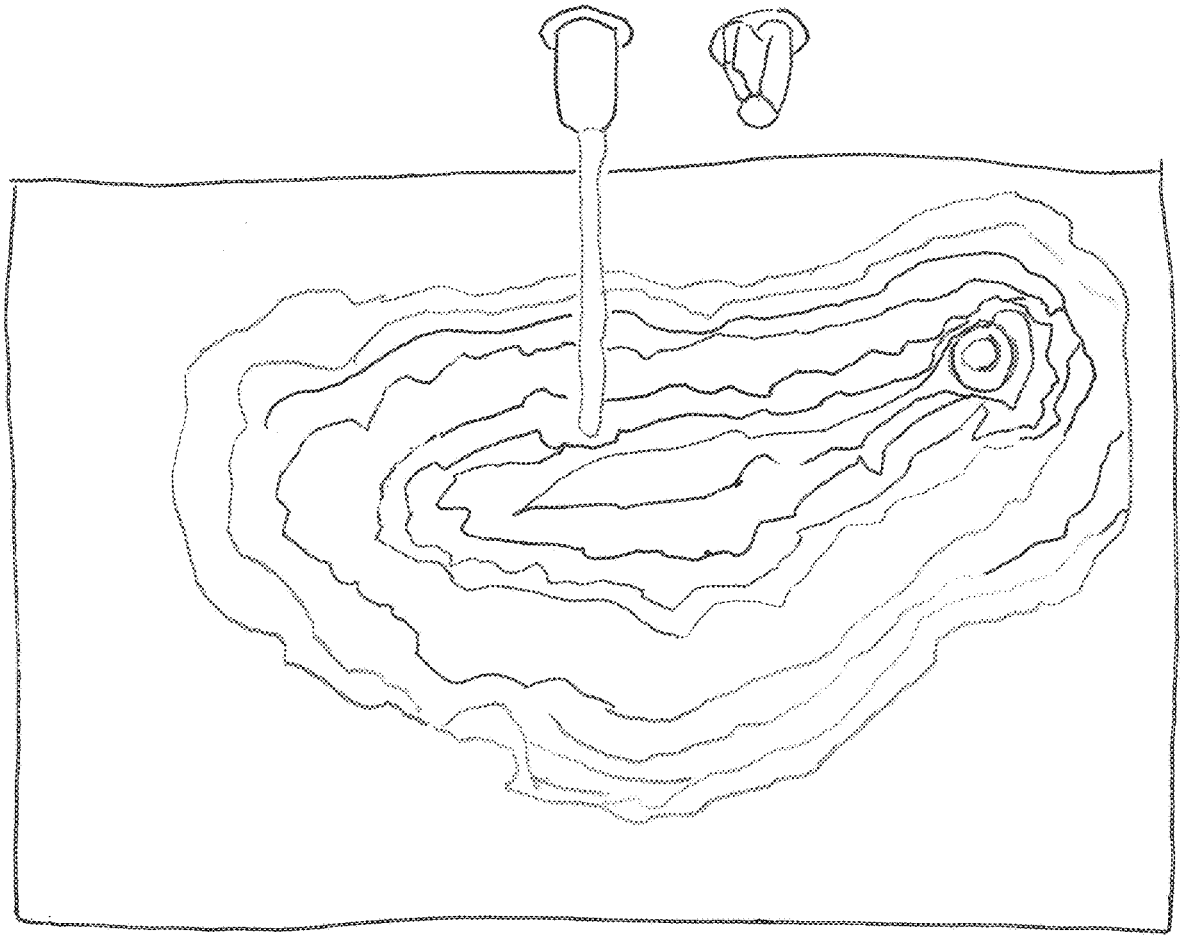
FIG. 7 is a plan view of a prior art sink.

FIGS. 1-7 show a sink 10 of the presently preferred embodiment of the present invention. Sink 10 has a basin or partial sink bowl 12 as shown extending through and/or into an upper counter surface 14 with at least some or more of a series of elevational steps 16,18,20,22,24,26,28,30,32 whereby the bottom step 32 may be the bottommost bowl layer. Each of the layers or steps 16-32 preferably cooperate to form a partial sink bowl 12 except that these layers or steps 16-32 are formed as partial perimeters, possibly irregularly shaped partial perimeters, that extend about the bowl 12 towards at least one side edge 34 where the perimeters are not continuous as it relates to the upper surface 14 but instead allow the bottommost surface 32 to be horizontal or slightly downwardly extend as it proceeds toward the side edge 34 so as water will drain off the side 36 either into leg 38 or towards a floor drain 40. Perimeters of steps 16-32 could be more regular in shape, and comprise continuous curves, linear lines, etc. for other embodiments.

Water may be directed in the sink bowl 12 from a faucet 42 which preferably extends an elevation 44 above the upper surface 14. Upper surface 14 of sink 10 may be planar and/or horizontal for many embodiments. The bottom step 32 may be coplanar with the upper surface 14 for many embodiments and/or be slightly elevationally downwardly directed towards edge 34 so as to create a waterfall at the side 36 as will be explained in further detail below.

There is preferably no drain internal to the bowl 12 as it relates to the upper surface 14 of the sink 10. Instead, water drains off the side 36 preferably along the leg 38 towards the drain 40 which may be external to the sink 10, such as on the floor 70 as illustrated, or internal to the leg 38 and/or both. Sink 10 may be constructed of various materials such as composite stone or other appropriate materials.

Each of the separate steps 16-32 may be slightly downwardly oriented so as to direct any water thereon down towards the bottom step 32 or horizontal but do not intentionally create difficult places to catch water and/or clean. Vertically upwardly extending walls separate adjacent steps 16-32. A similar construction could be provided with the construction along or into the side 36 as explained below.

Faucet 42 preferably extends a distance 44 above the upper surface 14 for at least some embodiments. Upwardly extending canyon walls such as 46,48, etc. separating layers or steps 16-32 such as first layer 16 from upper level 14 with wall 46 and or first level 16 from second level 18 with wall 48, etc. Walls 46,48 can be vertically extending or non-acutely angled with the lower level 16,18 etc., so as not to create a location for water to accumulate with debris therein for many embodiments. The upwardly extending canyon walls 46,48 are preferably obtusely angled with the next lower level 16,18 downwardly oriented relative to the bottom step 32 to assist in draining water down towards it. As can be seen in reference to FIG. 2, the contour levels on the side 36 may, or may not, have a similar construction as the upwardly extending walls separating the various contour levels or steps 16-32 provided thereby.

The contour levels on or into the side 36 may correspond in number to those extending into the upper surface 14 or may be different for various embodiments. The contour levels on the side 36 may terminate at the innermost level 60 or extend outwardly extend relative to innermost step 60 as provided in FIG. 2 to level 62, etc. As water proceeds downwardly down channel 66, the water may also proceed outwardly in the direction 64 towards drain 40 for at least some embodiments such as to step 62, etc. For other embodiments water may proceed straight down. A catch 64 may assist in retaining water internal to the leg 36 and/or water may be directed into drain 40 whether external to the leg 36 and/or internal thereto.

Accordingly, for many embodiments the sink 10 provides an upper counter surface 12 having a series of decreasing partial upper perimeter contour levels as steps 16-32 which do not provide a completely bounded perimeter, but instead extend towards a common edge 34 whereby a downwardly extending channel 66 is formed or otherwise provided at and/or into a side 36 of the sink 10 whereby water entering a basin or partial sink bowl 12 formed by the series of decreasing contours steps 16-32, is directed into the channel 66 which is initially exposed and viewable from the side 36 and proceeds down the side 36 towards the drain 40.

The channel 66 may have contoured sides or side steps 70-86 and 60 which can correspond in number to the contour level construction of the upper counter surface with steps 16-32, or not, for various embodiments. Side Steps do not comprise a continuous perimeter but are open at side edge 34 (where they can potentially join steps 16-32), or not. The inner surface 60 of the channel 66 is preferably substantially planar or is downward directed towards the edge in the channel and may be perpendicular or obtusely angled relative to the channel 66 whereby the channel 66 may extend obtusely relative to a floor surface 70 so that as water comes off the bottom step 32 it can then proceed outwardly against the channel 66 as it proceeds downwardly towards a drain 40 in the direction 64.

The upper counter surface 14 may be planar. The side 36 may have a side planar surface into which the channel 66 as well as side steps. Steps 16-32 and/or 70-86 respectively, need not be parallel for all embodiments but could converge or diverge towards one another, such as meeting at a common interface, etc.

For some embodiments, the side contours or steps 70-86 and/or 60 may be perpendicular to respective upper steps 16-32 and may correspond directly thereto. The contour steps 16-32 may be slightly downwardly angled towards either towards the channel 66 for the side steps 70-86 and/or towards the bottom step 32 for the upper contour steps 16-30. Canyon walls 46,48 which separate steps 16-32 may be vertically oriented or may be obtusely angled relative to the next lower layer 16-32 so as to assist in draining and/or cleaning.

Bottom step 32 may sharply meet at interface 88 which could be a sharp line with inner surface 60 of the channel 66 or it may be a more gradual transition such as a curve of various radius or radii and/or have other effects. The channel 66 is preferably viewable as the water proceeds over the interface 88 and down into the channel 66 possibly even above a step such as above step 86 for some embodiments or not, depending on the relative flow of water from the partial sink bowl 12. There are various materials that could be used whether artificial stone products, concrete, plastics and/or other materials and/or combinations thereof. Leg 36 may or may not be integrally formed with upper surface 14.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the intention are intended to be included within the scope of the appended claims.

Having thus set forth the nature of the invention, what is claimed herein is:

1. A waterfall sink comprising:

a partial bowl comprised of a series of elevationally spaced apart upper steps descending relative to an upper surface toward a bottom surface, with the upper steps providing partial perimeters proceeding towards at least one side edge, said bottom surface directing fluid towards and over the side edge below the upper surface and downwardly relative to a side towards a drain located below the bottom surface of the partial bowl.

2. The waterfall sink of claim 1 wherein the upper surface is planar extending to the side edge.

3. The waterfall sink of claim 2 wherein the side has a planar outer surface with a channel therein and the bottom surface of the partial bowl directs fluid downwardly along the channel.

4. The waterfall sink of claim 3 wherein the channel has side steps which continue the partial perimeters of the upper steps as they proceed downwardly along the side.

5. The waterfall sink of claim 4 wherein the partial perimeters comprise at least one of irregular shapes, continuous curves and line segments.

6. The waterfall sink of claim 4 wherein the upper steps have vertically extending walls spacing apart adjacent upper steps.

7. The waterfall sink of claim 6 wherein the vertically extending walls are one of perpendicular to and obtusely angled relative to a next lower upper step of the upper steps.

8. The waterfall sink of claim 3 further comprising side steps continuous at the side edge with the upper steps.

9. The waterfall sink of claim 3 further comprising side steps extending perpendicularly downwardly relative to the upper steps along the side.

10. The waterfall sink of claim 9 wherein the side steps converge as the side steps proceed downwardly along the side to be co planar along the side.

11. The waterfall sink of claim 3 wherein the side is a leg and the drain is located at the bottom of the leg.

12. The waterfall sink of claim 11 wherein the leg is integrally formed with the upper surface.

13. The waterfall sink of claim 3 wherein the drain is one of at a floor and internal to the side.

14. The waterfall sink of claim 13 wherein further comprising a catch along the side, said catch spanning the channel and receiving fluid from above as directed off the side edge.

15. The waterfall sink of claim 3 wherein the bottom surface is one of horizontal and downwardly angled toward the side edge, and the channel is one of perpendicular to the bottom surface and obtusely angled relative to horizontal.

16. The waterfall sink of claim 1 wherein the bottom surface is one of horizontal and downwardly angled toward the side edge.

17. The waterfall sink of claim 1 further comprising a faucet extending above the partial bowl directing water downwardly there into.

18. The waterfall sink of claim 17 wherein the faucet is elevationally spaced above the upper surface.

19. The waterfall sink of claim 1 wherein the upper steps are downwardly angled toward the bottom surface.

20. The waterfall sink of claim 1 wherein the partial bowl is made of a unitary material selected from the group of artificial stone, concrete and plastics.

* * * * *